US005269735A

United States Patent [19]

Pfitzenmeier

[11] Patent Number: 5,269,735

[45] Date of Patent: Dec. 14, 1993

[54] FLOOR BORNE FITNESS APPARATUS WITH VARIABLE STEP HEIGHTS

[75] Inventor: Werner Pfitzenmeier, Schwetzingen, Fed. Rep. of Germany

[73] Assignee: Werner Pfitzenmeier Verwaltungs GmbH, Schwetzingen, Fed. Rep. of Germany

[21] Appl. No.: 914,986

[22] Filed: Jul. 16, 1992

[30] Foreign Application Priority Data

Jul. 20, 1991 [DE] Fed. Rep. of Germany ..... 9108940

[51] Int. Cl.[5] ..... A63B 22/04; A63B 21/075

[52] U.S. Cl. ..... 482/52; 472/108; 472/135; 482/34; 482/96

[58] Field of Search ..... 272/34, 51, 52; 482/34, 482/51, 52, 96, 143, 144, 140, 142; 472/106-115, 135

[56] References Cited

U.S. PATENT DOCUMENTS

| | | | |
|---|---|---|---|
| 1,363,097 | 12/1920 | Duncan | 472/112 |
| 1,752,110 | 3/1930 | Remy | 472/106 |
| 2,947,009 | 8/1960 | McKenzie | 472/106 |
| 3,081,085 | 3/1963 | De Girolamo | 482/144 |
| 4,198,044 | 4/1980 | Holappa . | |
| 4,492,376 | 1/1985 | Schatz et al. . | |
| 5,116,044 | 5/1992 | Wilkinson et al. | 482/52 |

FOREIGN PATENT DOCUMENTS

| | | | |
|---|---|---|---|
| 0195671 | 9/1986 | European Pat. Off. . | |
| 227751 | 9/1909 | Fed. Rep. of Germany . | |
| 1428843 | 11/1968 | Fed. Rep. of Germany . | |
| 2711104 | 9/1978 | Fed. Rep. of Germany . | |
| 8019321 | 10/1980 | Fed. Rep. of Germany . | |
| 3136451 | 3/1983 | Fed. Rep. of Germany . | |
| 2410486 | 6/1979 | France . | |
| 9104767 | 4/1991 | PCT Int'l Appl. | 482/52 |
| 2194455 | 3/1988 | United Kingdom | 482/96 |

*Primary Examiner*—Richard J. Apley
*Assistant Examiner*—Donna L. Maraglio
*Attorney, Agent, or Firm*—Anderson Kill Olick & Oshinsky

[57] ABSTRACT

A floor-borne fitness apparatus with variable stepping heights includes an upper stepping floorboard and substructural parts which can increase the height and/or the inclination of the floorboard. The apparatus has at least one attachment element which can cooperate with an exercise expander band. The floorboard cooperates with the substructural parts in such a way as to form a positively engaging support unit. Such construction prevents the unintended tilting of the apparatus.

12 Claims, 1 Drawing Sheet

FLOOR BORNE FITNESS APPARATUS WITH VARIABLE STEP HEIGHTS

FIELD OF THE INVENTION

The present invention is directed to a fitness apparatus and more particularly to floor or ground borne fitness apparatus having variable stepping heights.

BACKGROUND OF THE INVENTION

Exercise, or "step," boards of wood or plastic material used, for instance, for aerobic fitness, are well known. Such boards use gravity (i e., as the exerciser steps "up" onto it) in order to achieve such fitness. Single part or multiple base exercise boards, or steps, are available on the market. The single part apparatus typically comprises an elongated, box-shaped step-on board with oblique side walls and upper stepping area having a rubber covering. Such steps, or exercise boards, are not adjustable in height.

The multi-part apparatus uses small abutting parts which fit into each other below the exercise, or step, board in order to achieve the desired stepping heights. If the same number of abutting lower parts are arranged at both ends of the exercise, or step, board, the board is horizontal—i.e., parallel to the ground. If differing numbers of lower parts are arranged on each side of the footboard, the board is inclined with respect to the horizontal axis. These apparatuses have the advantage of being able to adjust the horizontal height, as well as to vary the angles of inclination to achieve the desired fitness or exercise program. When in the horizontal orientation, the apparatuses should not afford a tlt when one steps upon the edge area of the longitudinal or end faces. When the board is inclined however, there is a greater risk problem when stepping upon the edges of the apparatus. Indeed, the greater the incline, the greater is such risk, particularly when stepping upon the higher end faces which would create a considerable tilting moment with risk of accident because of the loss of centering between the footboard and the lower or bottom part, with increasing inclination or slope. The same applies when stepping upon the longitudinal edges. Furthermore, the footboards have a tendency to skid downwards when using the inclined arrangement.

These known fitness apparatuses embody only purely static construction units with variable height and inclination possibilities for relatively one sided or partial fitness exercises.

It is therefore an object of the invention to create a versatile floor-borne fitness apparatus which provides protection against tilting in any arrangement.

Another object of the invention is to provide a versatile floor-borne fitness apparatus which enables it to be used in a dynamic manner and is also suitable for arm-body-training.

SUMMARY OF THE INVENTION

To achieve these and other aspects of the invention, which will become apparent hereafter, a floorborne fitness apparatus with variable step heights which assures against unintended tilting in all structural positions (horizontal, inclined, and as a rocker) and in which the footboard does not slide away is disclosed. The unintended tilting or sliding is prevented by arc-shaped contact surfaces between the substructural shape of the foot boards, which always provide a positive engagement with each other at different inclination angles.

Another aspect, of the invention facilitates its use as a rocker with dynamic user effect for balance fitness exercises executed when standing, kneeling, or sitting, for instance, in the training program of ballet-and modeling-schools. The apparatus may also be used as a children's toy—as a rocker without any peril because of its low constructional height in this aspect of the invention.

The apparatus of the invention is furthermore equipped with attachment lugs for receiving expander bands in order to be able to complete a well-rounded fitness program. This application of the apparatus according to the present invention is particularly useful in convalescent periods, i.e., after bodily injury, when by using the expander bands with increasing stretching force the desired increase in output can be obtained.

BRIEF DESCRIPTION OF THE DRAWINGS

The invention will be better understood from the Detailed Description of the Preferred Embodiment in connection with the following drawings which.

DETAILED DESCRIPTION OF THE PREFERRED EMBODIMENT

Figure 1:
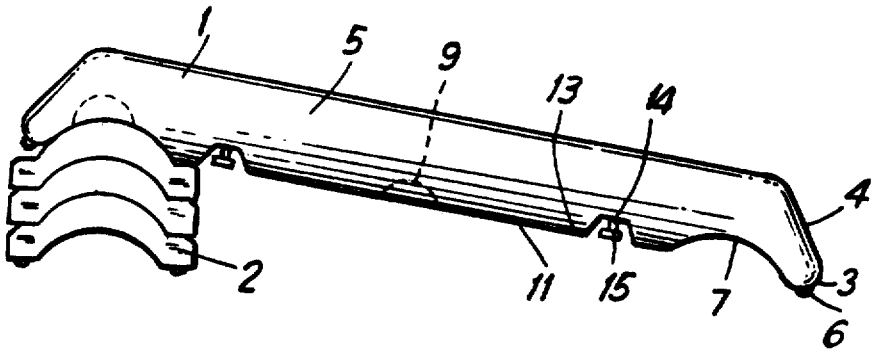
FIG. 1 is a side, schematic view of the floor-borne fitness apparatus with variable step heights depicted in inclined construction.

Reviewing now the drawings wherein like numerals reflect like elements throughout the several views, FIG. 1 depicts a side view of the floor-borne fitness apparatus with variable step heights comprising an elongated or quadratics box-shaped upper exercise or footboard 1 having oblique side walls and associated substructures 2. The footboard 1 has a rubber covering on its upper side. Two contact or support edges are located at the end faces 4 and the longitudinal faces 5 on the bottom side of the footboard. If the footboard 1 is used without the substructural parts 2, it rests on the ground on two support or contact edges 3 having four legs 6 of an antiskid material at the four corners. The two support edges of the longitudinal sides 5 are arranged slightly higher. Two arc-shaped recesses 7 are located near the end faces 4 at the support edges 11. The recesses 7 rest in a positively engaging manner on the substructural parts 2. These support points are provided for the horizontal and the inclined arrangement.

Figure 2:
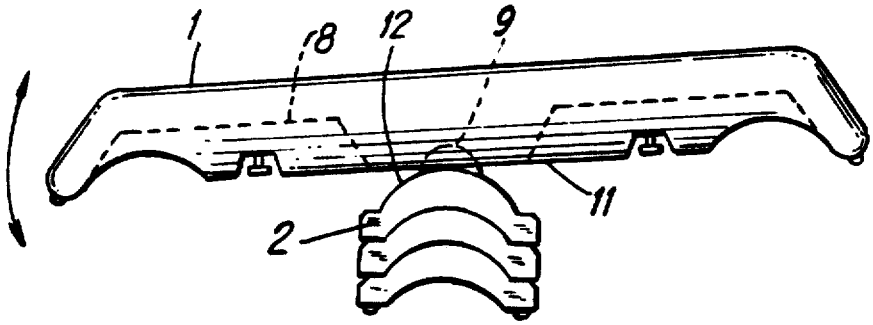
FIG. 2 is the fitness apparatus designed as a rocker.

Several girder-like longitudinal ribs 8 are located for stiffening purposes below the stepping face of the footboard. These have in the center, under the transverse axis, additional arc-shaped recesses 9 for contact or support purposes if the apparatus is to be used as a rocker as shown in FIG. 2. The footboard 1 then lies upon the upper, smaller arc-shaped buildup, or structure, 10 of the substructure part 2. The smaller radius extending deeper at this support point causes a better centering for dynamic loads between the footboard 1 and substructure 2. The support or contact faces 9 are located in the rib area and therefore lie inwardly beneath the footboard 1. The bottom edges 11 of the two longitudinal sides 5, shown in solid lines, which are located with slight clearance above the two outer-arched support faces 12 of the substructure part 2 and which can abut against the same, help prevent sidewise tilting of the apparatus.

Figure 4:
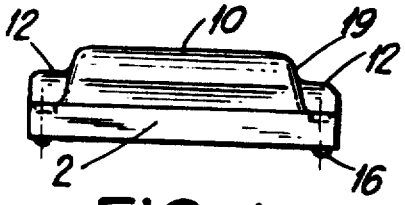
FIG. 4 is a longitudinal, side view of the substructure of the apparatus.
Figure 5:
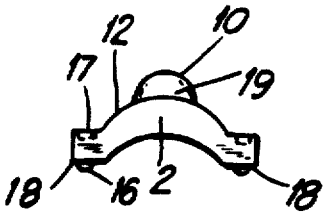
FIG. 5 is a front view of a substructure of the apparatus.

Substructure part 2 has a rectangular shape and stands on four legs, or supports, 16 (see FIGS. 4 and 5) of antiskid material arranged beneath the corners. Four depressions 17 are located at the upper side of the substructure part 2 precisely above the legs 16 and receive the legs 16 of the additional stacked substructure pat 2. The substructure part 2 always remains in a horizontal position. The top side of the substructure part has upwardly arched or curved support or contact faces 12 in the end area. Between these, an additional continuous upper support face 10, arched towards the top in an arc-shaped manner and located at a higher level, is arranged along the longitudinal axis. This support face has a smaller arc radius than the two outer support faces 12. The two end sides 19 serve as a side contact for the footboard 1 placed thereon.

The substructure part 2 has a rectangular or quadratic aperture at the bottom side for fitting additional substructure parts 2 into each other when stacking. The base area of the substructure part has two outwardly arranged horizontal support faces 18, in between which, it extends to be arched upwards. The geometry of the base area corresponds to the geometry of the support face arranged on top of it. An upper support face which has already been described is additionally arranged on top of this.

Figure 3:
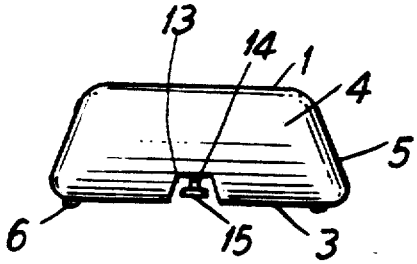
FIG. 3 is an end view of the footboard of the apparatus.

The footboard 1 has additional recesses 13 at the bottom at its four sides open towards the ground. Downwardly oriented lugs 14 are secured at the underside of the board, within the recesses (see FIG. 1 and 3). Heads 15 of plastics material or rubber are placed upon the exposed bottom ends of the lugs 14. The lugs 14 facilitate the attachment of expander bands and the heads 15 prevent unintended detachment of the expander bands.

The bottom edges 11 at the longitudinal sides of the footboard 1 are arranged to be higher than the bottom edges 3 of the end faces. Thus, when the footboard 1 is on the ground, a free space is formed below the lower edges 11. An expander band can be pushed through the free space beneath the head 15 of the lug 14 for attachment or detachment, without having to lift up the footboard. The lugs 14 at the end faces 4 are accordingly installed at a slightly higher level.

Figure 6:
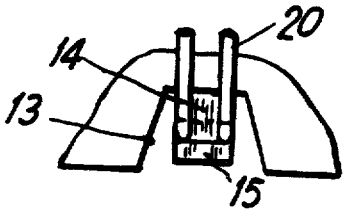
FIG. 6 is a detailed, cross-sectional view of the fastening, or attachment, element of the apparatus with an expander band installed thereon.

FIG. 6 is a magnified cross-sectional view of the retention or attachment element, configured, in this embodiment, as lug 14 with head 15 projecting downwardly in recess 13. Since the head 15 projects beyond the diameter or the dimension of the lug 14, an expander band 20 can be attached and safely retained in order to perform the required exercises.

While the preferred embodiment of the invention has been described in detail, modifications and adaptations thereof may be undertaken without departing from the spirit and scope of the invention as defined in the following claims:

What is claimed is:

1. A floor-borne fitness apparatus, comprising:

a footboard, having:

a substantially flat upper side, opposite end faces extending substantially transverse to said upper side, a bottom side extending between said opposite end faces, and at least one arc-shaped recess formed in said bottom side adjacent to one of said end faces; and a plurality of separate arc-shaped substructural parts adapted to be placed one on top another for varying an inclination of said footboard, each of said plurality of substructural parts, having:

an upper convex arc-shaped surface complementary to said arc-shaped recess and adapted to be received therein, and a lower concave arc-shaped surface, substantially identical to said arch-shaped recess, for receiving the upper convex arc-shaped surface of another of said plurality of substructural parts.

2. The floor borne fitness apparatus of claim 1, further wherein:

said footboard has a center arc-shaped recess having a radius which is smaller than that of said at least one arc-shaped recess; and one of said plurality of separate arc-shaped parts have, at an apex of said upper convex arc-shaped surface, an arc-shaped build-up-complementary to said center arc-shaped recess and adapted to be received therein whereby, upon stacking of aid separate substructural parts in a center of said footboard with said one of said plurality of separate substructural parts being on top, said fitness apparatus functions as a roker having an adjustable height.

3. The floor borne fitness apparatus of claim 1, further comprising two support edges defined at last partially by said opposite end faces; and two pairs of legs formed of an antiskid material and arranged at opposite ends of said two support edges.

4. The floor borne fitness apparatus of claim 1, wherein said footboard has spaced side faces extending between said opposite end faces and wherein said at least one arc-shaped recess is formed in said spaced side faces.

5. The floor borne fitness apparatus of claim 1, wherein said footboards and said substructural parts have corresponding rectangular shapes.

6. The floor borne fitness apparatus of claim 5, wherein each of said plurality of separate arc-shaped parts comprises:

two horizontal support portions extending outwardly on opposite sides of an arc-shaped portion thereof, each of aid horizontal support portions having upper and bottom surfaces;

two support legs formed of an antiskid material and located at opposite ends of the bottom surface; and tow depressions formed in the upper surface precisely above said support legs for receiving respective support legs of an above-located substructural part.

7. The floor borne fitness apparatus of claim 1, further comprising at least one attachment element secured to said footboard, said fitness apparatus further including, in combination, an exercise assist means attachable to said footboard.

8. The floor borne fitness apparatus of claim 7, wherein said bottom side of said footboard has an additional recess and said attachment element comprises a lug secured in said recess, and said exercise assist means comprises expander band mans securable to said lug.

9. A floor borne fitness apparatus, comprising:

a footboard having:

a substantially flat upper side, opposite end faces extending transverse to said upper side, a bottom side and an ac-shaped recess formed in said bottom side adjacent to one of said end faces and having a first radius, and a center arc-shaped recess formed in said bottom side in a center of said footboard and having a second radius smaller than said first radius, and variable height convexly arc-shaped substructural means for varying one of inclination and height of said footboard and having:

an upper convex arc-shaped surface complementary to said arc-shaped recess and adapted to be received therein, and a convex arc-shaped buildup formed at an apex of said convex arc-shaped surface and complementary to said center arc-shaped recess, whereby said variable height arc-shaped substructural means can be arranged at one of said one end face and the center of said footboard.

10. The floor borne fitness apparatus of claim 9, further comprising at least one attachment element secured to said footboard, said fitness apparatus further including, in combination, an exercise assist means attachable to said footboard.

11. The floor borne fitness apparatus of claim 10, wherein said bottom side of said footboard has an additional recess and said attachment element comprises a lug secured in said recess, and said exercise assist means comprises expander band means securable to said lug.

12. The floor borne fitness apparatus of claim 9, wherein said footboard is box-shaped.

* * * * *